US011732854B2

(12) United States Patent
Bechter et al.

(10) Patent No.: US 11,732,854 B2
(45) Date of Patent: Aug. 22, 2023

(54) TROUGH-SHAPED LAMP HOUSING

(71) Applicant: ZUMTOBEL LIGHTING GMBH, Dornbirn (AT)

(72) Inventors: Wolfgang Bechter, Dornbirn (AT); Michael Spiegel, Dornbirn (AT); Claudio Ender, Dornbirn (AT)

(73) Assignee: ZUMTOBEL LIGHTING GMBH, Dornbirn (AT)

( * ) Notice: Subject to any disclaimer, the term of this patent is extended or adjusted under 35 U.S.C. 154(b) by 43 days.

(21) Appl. No.: 17/610,582

(22) PCT Filed: Jan. 20, 2020

(86) PCT No.: PCT/EP2020/051235

§ 371 (c)(1),
(2) Date: Nov. 11, 2021

(87) PCT Pub. No.: WO2020/228993

PCT Pub. Date: Nov. 19, 2020

(65) Prior Publication Data

US 2022/0316671 A1 Oct. 6, 2022

(30) Foreign Application Priority Data

May 15, 2019 (DE) ..... 10 2019 112 687.8

(51) Int. Cl.
*F21S 8/04* (2006.01)
*F21Y 105/10* (2016.01)
*F21Y 115/10* (2016.01)

(52) U.S. Cl.
CPC ..... *F21S 8/043* (2013.01); *F21Y 2105/10* (2016.08); *F21Y 2115/10* (2016.08)

(58) Field of Classification Search
CPC .. F21S 8/02; F21S 8/04; F21V 15/013; F21V 15/01; F21V 23/009; F21Y 105/10; F21Y 115/10
See application file for complete search history.

(56) References Cited

U.S. PATENT DOCUMENTS 9,791,142 B2 10/2017 Favarolo et al.
2008/0278957 A1* 11/2008 Pickard ..... F21S 8/02 362/373
2015/0338084 A1* 11/2015 Ryder ..... F21V 17/12 362/365

FOREIGN PATENT DOCUMENTS

CA 2390604 A1 5/2001
EP 1232588 A2 8/2002
(Continued)

*Primary Examiner* — William J Carter
(74) *Attorney, Agent, or Firm* — Volpe Koenig

(57) ABSTRACT

A trough-shaped lamp housing (10) which is integrally produced in a deep-drawing process and has a housing bottom (11) and a housing wall (12) which laterally surrounds the housing bottom (11) and which, together with the housing bottom (11), delimits a lamp chamber, wherein the housing bottom (11) has a planar region (20, 25) for receiving at least one lamp component (120, 130) in a planar manner, wherein the planar region (20, 25) is circumferentially surrounded by a raised and/or recessed annular structure (35) which is integrally formed in a deep-drawing process, and wherein the housing wall (12) discontinues at the circumferential edge thereof that faces away from the housing bottom (11) in a circumferentially closed edge portion (16), which lies in a plane.

14 Claims, 11 Drawing Sheets

(56) References Cited

FOREIGN PATENT DOCUMENTS

| | | | |
|---|---|---|---|
| WO | 0139407 | A2 | 5/2001 |
| WO | 2013117546 | A1 | 8/2013 |
| WO | 2014086770 | A1 | 6/2014 |

* cited by examiner

TROUGH-SHAPED LAMP HOUSING

FIELD OF THE INVENTION

The present invention relates to a trough-shaped lamp housing used for the realization of a lamp. In particular, a so-called high bay lamp is to be formed with the aid of the lamp housing.

BACKGROUND

High bay lamps are understood to refer to lamps that are used, for example, in order to illuminate larger halls or industrial complexes. In this case, the lamps are typically mounted at a relatively large distance from the bottom, and therefore there is a requirement that the lamp generate high intensity lamp, which is then radiated onto the underlying region, for example a hall. Accordingly, in such lamps, relatively high-performance illuminants are used which must then be mounted in a suitable manner, taking care to ensure on the one hand that the heat occurring during operation of the illuminants is dissipated in a suitable manner and that the illuminants are protected on the other hand against external influences, in particular moisture and/or dust.

A lamp of the aforementioned type is known, for example, from WO 2014/086770A1 of the Applicant. The lamp described therein is essentially formed by an aluminum die-cast body having expansive cooling fin structures and cooling channels for dissipating the high heat generated during operation of the illuminants. Operating means are positioned centrally between two elongated LED arrangements, wherein the design of the die-cast body is such that a centrally arranged housing in which the operating means are accommodated can also be circumvented by air in order to allow sufficient heat dissipation. By using corresponding cool air openings, a thermal decoupling between the housing for the operating means and the regions of the lamp body in which the illuminants are arranged is also achieved to the greatest possible extent.

The lamp known in the prior art has proven itself in many ways and is characterized by its excellent light output and at the same time high operational reliability. However, the cost of material through the use of the die-cast aluminum body is relatively high, and the lamp itself consists of a plurality of parts, which on the one hand leads to high material costs and on the other hand to increased effort in the assembly of the lamp.

The present invention is therefore based on the problem of providing a lamp that is comparable in terms of its lighting-technical properties, but in which the effort of production and assembly is reduced.

This problem is overcome by a lamp housing having the features according to the independent claim. Advantageous further developments of the invention are the subject matter of the dependent claims.

SUMMARY

According to the present invention, the effort for realizing a high-performance lamp is reduced in that, instead of the die-cast body used in the prior art, a trough-shaped lamp housing integrally produced in a deep-drawing process is used. This lamp housing, which can thus be produced significantly more simply and more cost-efficiently according to the invention, has a housing bottom and a housing wall which laterally surrounds the housing bottom and which, together with the housing bottom, delimits a lamp chamber. The housing bottom has a planar region for receiving at least one lamp component in a planar manner, wherein this region is circumferentially surrounded by a raised and/or recessed annular structure which is integrally formed in a deep-drawing process. It is further provided that the housing wall discontinues at the circumferential edge thereof that faces away from the housing bottom in a circumferentially closed edge portion, which lies in a plane. The described measures on the one hand permit the simple and efficient mounting of the lamp components required for the lamp operation, wherein a thermal coupling to the housing is also achieved, which allows a heat dissipation that is required for reliable operation. At the same time, however, the measures according to the invention also result in the housing having sufficient stability overall.

According to the present invention, a trough-shaped lamp housing is proposed, which is integrally produced in a deep-drawing process and which has a housing bottom and a housing wall which laterally surrounds the housing bottom and which, together with the housing bottom, delimits a lamp chamber,

- wherein the housing bottom has a planar region for receiving at least one lamp component in a planar manner
- wherein the planar region is circumferentially surrounded by an integrally formed, raised and/or recessed annular structure formed in a deep-drawing process, and
- wherein the housing wall discontinues at the circumferential edge thereof that faces away from the housing bottom in a circumferentially closed edge portion, which lies in a plane.

The edge portion, which significantly increases the stability of the housing but also has a positive effect on the appearance of the lamp, is preferably configured such that the aforementioned plane extends substantially parallel to the housing bottom of the trough-shaped lamp housing. In this case, it can in particular be provided that the edge portion is oriented laterally outward from the lamp chamber.

The aforementioned annular structure, which surrounds the planar receiving region of the housing bottom, preferably has a wave shape in cross section and/or a circumferentially substantially closed groove or recess projecting from the lamp chamber. It is preferably provided here that the annular structure extends in a plane. If the lamp housing has a plurality of corresponding regions for receiving lamp components in a planar manner which are respectively surrounded or delimited by corresponding annular structures, it is particularly provided that all annular structures extend in the same plane.

According to another advantageous further development of the invention, the stability of the lamp housing can further be improved by the fact that the housing wall has structural elements which are integrally formed in a deep-drawing process.

An important requirement for the lamp housing according to the invention is not only that it can be produced in a simple manner, but moreover that the lamp components are also mounted in a suitable manner and it is ensured that they are cooled during operation or the heat generated during operation is dissipated. Accordingly, according to a particularly preferred further development of the invention, it can be provided that one or more through-openings are configured in the housing bottom of the lamp housing. In particular, a circumferentially closed edge, which delimits the through-opening(s), can extend transversely to the portion or part of the lamp housing comprising said edge, wherein the edge is in turn configured as an edge that is curved in a deep-drawing process. Preferably, the through-opening(s) can extend adjacent to the planar regions for receiving lamp components, wherein, in the event that a plurality of planar regions are provided for receiving lamp components in a planar manner, two adjacent planar regions are separated from one another by a region with such through-openings. This arrangement of the through-opening(s) not only helps to ensure that cool air can be guided along the regions of the housing in which heat generation takes place during operation of the lamp. This measure also achieves a thermal decoupling between two adjacent regions, so that the heat generated by the illuminants, for example, cannot migrate into an adjacent region in which corresponding operating devices are mounted and possibly damage these devices.

As mentioned above, there is also a requirement for the lamp to the effect that the electronic components must be reliably protected against external influences, i.e. ideally sealed by corresponding components of the lamp. At the same time, however, it is necessary to reliably fasten the lamp components to the housing, for which reason, according to a further advantageous further development of the invention, the lamp housing can have one or more blind-hole structures projecting outwardly with respect to the lamp chamber for receiving fasteners. In particular, these fasteners can be screws, which can then be screwed into the blind-hole structures without penetrating the lamp housing. It is thus ensured that no leaks can occur in these regions, as well. The blind-hole structures can in particular be formed by structures that are integrally formed in a deep-drawing process or by separate structures, wherein the separate structures are connected to the housing bottom and/or the housing wall by means of a force lock, material lock, and/or positive lock.

The lamp housing according to the invention thus allows for a lamp to be formed in an efficient manner, having a housing according to the present invention as well as at least one illuminant, which is accommodated on the planar region in a planar manner.

BRIEF DESCRIPTION OF THE DRAWINGS

The invention will be explained in greater detail in the following, with reference to the appended drawings. The figures show.

DETAILED DESCRIPTION OF THE PREFERRED EMBODIMENTS

As aforementioned, the lamp according to the invention, which bears the reference number 1 in the figures and is described in more detail below, is intended to form a so-called high bay lamp, which is suitable as a compact but powerful lamp, for example, for use as a hall lamp. As with the lamp described in WO 2014/086770A1 of the Applicant, it is thus provided that the lamp 1 according to the invention shown here is arranged at a relatively large distance from the ground, wherein high-intensity light is to be generated, which is then radiated onto the underlying region, for example a hall.

Accordingly, the basic arrangement of the components responsible for the generation of light corresponds to the arrangement as provided in the lamp of WO 2014/086770 A1. This means that one or more operating devices are positioned in a central region of the lamp 1, wherein illuminants that are responsible for the generation of light and light radiation are arranged on both sides of the central region. However, the concept according to the invention can also be applied to other lamp forms, as will be explained below.

It should further be noted that, in the illustrated exemplary embodiment, two differently designed covers are shown which cover the illuminants and affect the light emitted by the illuminants. However, the representation of two different covers serves only to represent the different possibilities for the realization of the optical system. In reality, the covers and optical systems will preferably be identical in design for both illuminants.

Figure 1:
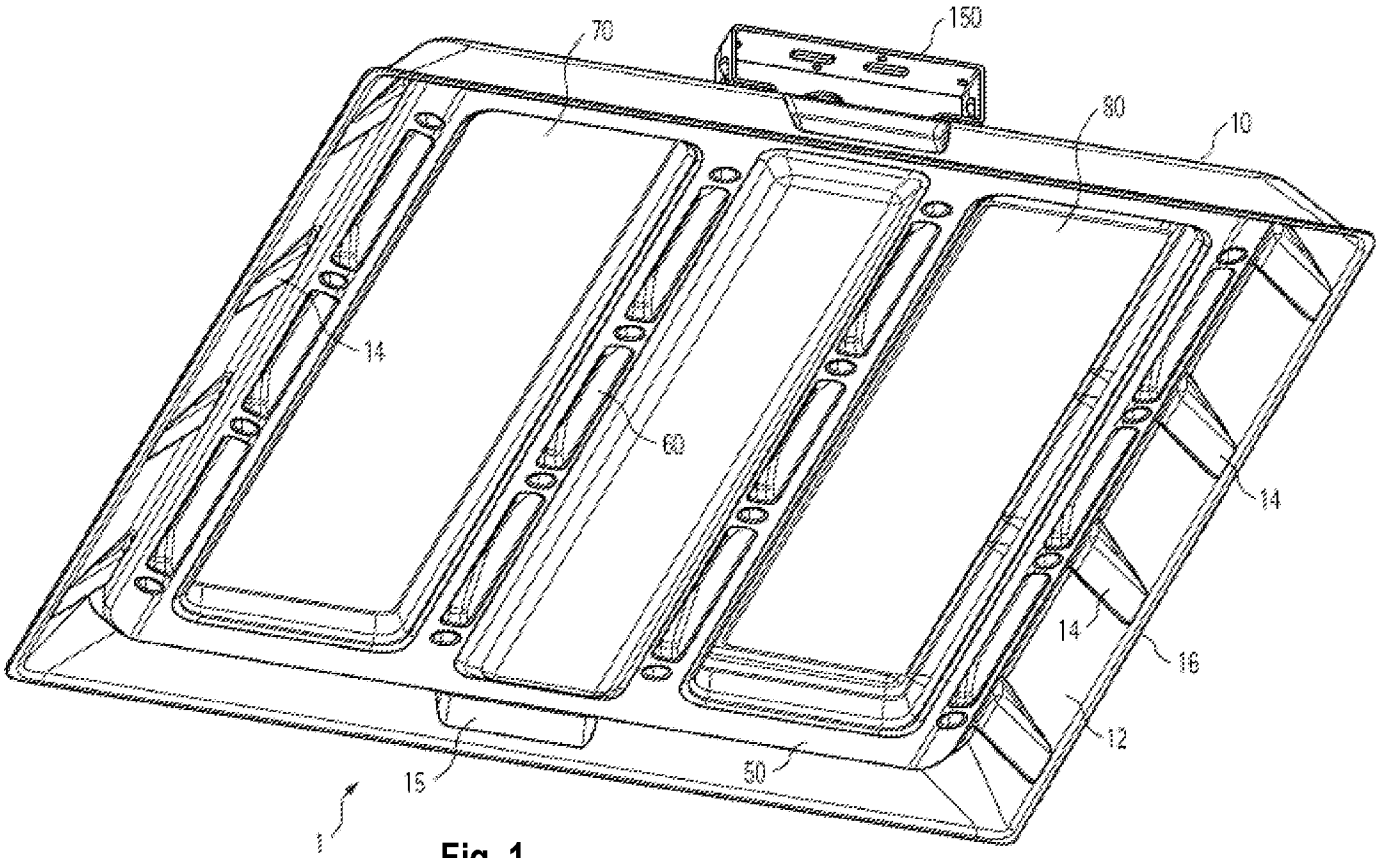
FIG. 1 the perspective view of a lamp having a lamp housing according to the invention.
Figure 2:
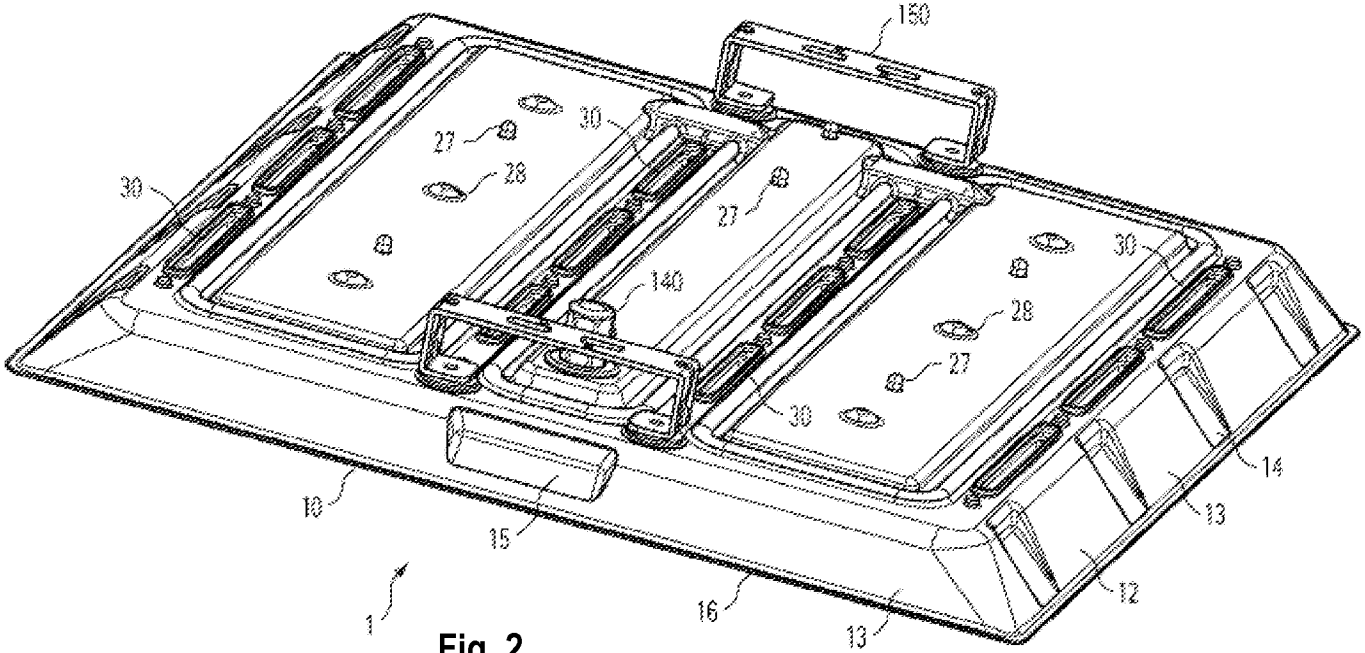
FIG. 2 a further top perspective view of the lamp according to FIG. 1.
Figure 3:
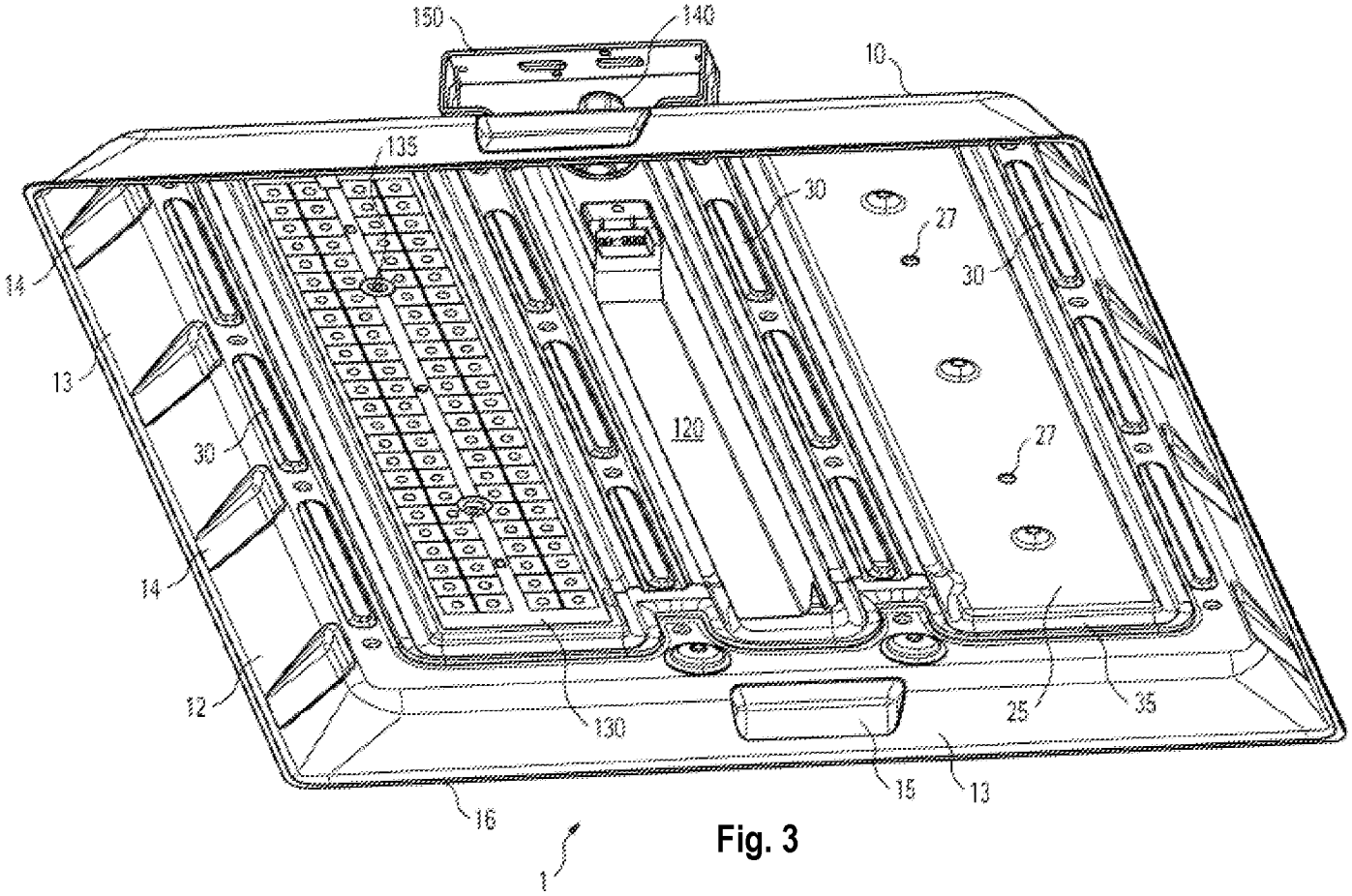
FIG. 3 a view of the lamp corresponding to FIG. 1, wherein covers of the lamp have been removed in order to illustrate in what way the lamp components are supported on the housing.
Figure 4:
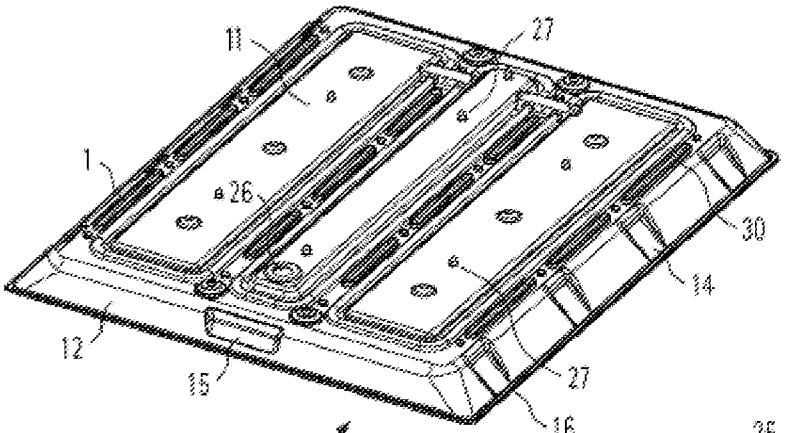
FIGS. 4 and 5 two views of the lamp housing according to the invention.

The essential components of the lamp 1 according to the invention are a trough-shaped lamp housing 10 as well as a retaining element 50 fastened to the lamp housing 10, which, if necessary, together with optical covers 70 and 80, enclose regions of the housing 10 in which electronic components of the lamp 1 are arranged for light generation. As with the lamp in the prior art, the lamp according to the invention is also divided into three regions, a central region running centrally along a longitudinal direction for the purpose of receiving an operating device, as well as two light output regions formed on both sides of the central region in which the illuminants and the optical components associated with the illuminants are arranged for the light output. Thus, in the view according to FIG. 1, the light is thus emitted via two substantially rectangular lateral regions of the lamp 1, via which high-intensity light is emitted.

A suspension or assembly of the lamp 1 can be carried out according to the illustrated example using brackets 150, which are connected to the latter on the two front sides of the central region on the rear side of the housing 10. The brackets 150 are arranged in such a way that they allow the assembly to be hung up or the suspension elements to be fastened. Of course, other mounting solutions for the lamp 1 are also conceivable.

First, the following explains in greater detail the design of the lamp housing 10, which represents a central component of the lamp 1 according to the invention.

As can in particular be seen in the illustrations of FIGS. 1 to 5, the lamp housing 10 is designed in a trough-shaped manner with a square housing bottom 11 in the illustrated design example, proceeding from which a laterally surrounding housing wall 12 extends downwardly or in the direction of light emission of the lamp 1, wherein the housing bottom 11 and housing wall 12 delimit a lamp chamber. The housing 10 is preferably made of sheet metal and is produced as part of a deep-drawing process, so that it can be produced easily and cost-effectively. The structural elements of the housing 10 described in more detail below can thus be formed in a relatively simple manner in a single work step; if necessary, a punching step can still be required before or after deep-drawing in order to form the through-openings and further openings as described in more detail below.

The primary problem of the housing bottom 11 is to enable a planar reception or mounting of the components of the lamp 1 responsible for the generation and output of light. Accordingly, the housing 10 is arranged such that the housing bottom 11 forms three substantially planar regions on its side facing the interior of the housing 10, a central planar region 20, and two lateral planar regions 25. The central region 20 is provided for receiving an operating device 120 that can be seen in FIG. 3, for example in the form of a converter. With regard to its width, it is substantially adapted to the width of the operating device 120 and is accordingly somewhat narrower than the two lateral receiving regions 25. All three regions 20 and 25 are configured as defined recesses in the bottom 11 of the housing 10.

The two lateral receiving regions 25 each serve to store one or more LED boards 130, each of which forms an expansive light source. In the illustration according to FIG. 3, the arrangement of the LED board(s) 130 is only shown on the left side, whereas on the right side the board is not shown in order to show the planar receiving region 25. All three receiving regions 20 and 25 are designed in this case—apart from the recesses described below—to be flat in order to enable a planar support of either the operating device 120 or the LED boards 130. This allows the heat to be transferred to the housing bottom 11 during operation, thereby improving the cooling of the lamp components 120, 130 and the heat dissipation, respectively.

The operating device 120 as well as the LED boards 130 can then be attached to the lamp housing 10 by means of a screw connection, for example, wherein the housing bottom 11 in the receiving regions 20 or 25 is formed with knobs or blind-hole structures 27 that project outwardly with respect to the lamp chamber. These blind-hole structures 27 are also created as part of the deep-drawing of the lamp housing 10 and allow the threads of the screws 135 to be cut into the respective sheet material of the blind-hole structure upon screwing in, and thus a secure fastening is achieved without the housing bottom 11 being penetrated by the screw 135. This solution is advantageous in that the housing bottom 11 can also be designed as sealed in the region of the fastening of the lamp components 120, 130. In principle, however, it would also be conceivable to subsequently weld or solder corresponding blind-hole structures to the housing bottom 11. The pressing of a corresponding component, which then allows the lighting components 120, 130 to be screwed into place with the housing 10, is also conceivable, wherein a solution is preferably aimed for in all cases which allows the lamp interior chamber to be dense in these regions towards the outside.

Only the central receiving region 20 additionally has a somewhat larger opening 26 on one end face, via which the passing of a power supply cable for the powering of the operating device 120 is enabled. In this case, corresponding sealing measures, e.g. in the form of a grommet 140, are then provided on the rear side of the housing 10, which measures enable the sealed removal of the power supply cable—not shown in further detail—such that all three receiving regions 20 and 25 are sealed towards the rear side in the assembled state of the lamp 1.

A significant characteristic of the lamp 1 according to the invention furthermore consists in the fact that the operating device 120 and the LED illuminants 130 are not arranged together in a single, densely enclosed chamber, but rather corresponding receiving regions 20 and 25 are formed, respectively, which are each sealed and each receive either the converter 120 or the LED illuminants 130. The separate arrangement of these lamp components 120, 130 in three separate chambers opens the possibility to thermally decouple the regions from one another on the one hand and to permit the flow of cool air through the interstices between two adjacent receiving chambers on the other hand.

It can be seen here that three elongated through-openings 30 in the housing bottom 11 are respectively formed on both sides of the central receiving region 20 and are a component of the cool air channels described in more detail below. Three through-openings 30 are also formed on the outer sides of the two receiving regions 25, so that cool air can flow along on both sides of the central receiving region 20 for the operating device 120 as well as along the receiving regions 25 for the LED illuminants 130. The through-openings 30 are each delimited by a circumferentially closed edge, which extends transversely to the portion of the lamp housing 10 comprising said edge. The through-holes 30, which could of course also be configured differently in terms of their length and, if necessary, their shape, furthermore cause a material reduction in the region between the central receiving region 20 and the lateral receiving regions 25, such that a certain thermal decoupling is present here and the risk is reduced, for example, that the heat generated by the LED illuminants 130 is transferred to the region 20 with the operating device 120.

The individual sealing of the three receiving regions 20, 25 is enabled in that the corresponding regions 20 and 25 are circumferentially surrounded by an annular seal, which cooperates with the retaining element or an optical cover, respectively, which is described in more detail below. In the preferred embodiment shown, it is provided that the planar receiving regions 20 or 25 are each circumferentially surrounded by a raised and/or recessed annular structure integrally formed in a deep-drawing process for the purpose of receiving the sealing. In particular, it can be provided that—as can be seen from the sectional view of FIG. 8—each receiving region is annularly surrounded by a shaft-like sealing structure 35, which comprises a circumferential groove or recess 36 in which the seal 40 is received. The recess 36 thus forms a circumferential channel in which the sealing material can be easily introduced. This can be a corresponding PU (polyurethane) foam, for example, which can be automatically injected into the recess 36 as part of the production of the lamp 1. It is advantageous here for the corresponding annular recesses 36 to all extend within the same plane, as this facilitates the automated application of, for example, the liquid-applied PU foam for sealing.

The wave-like cross-sectional shape prevents a flowing away of the applied sealing material, which collects at a deep point of the wave-like sealing structure 35 and, accordingly, will harden easily here. However, as an alternative to the aforementioned PU foam, other sealing materials or foams could also be used in order to implement the seal 40. For example, a strand of a corresponding sealing material could be inserted into the recesses 36. In principle, the use of so-called constructive sealing materials is also conceivable, wherein the shaft-like sealing structure 35 shown could then be omitted. The formation of a simple circumferential groove for receiving the sealing material would also be conceivable. However, the shaft-like structure also entails the further advantage that it leads to an additional increase in the stability of the trough body.

It is noted that, in spite of the circumferential sealing of the three receiving regions 20 or 25, there must be an electrical connection between the central receiving region 20 and the two lateral regions 25 in order to ensure that the operating device 120 can supply power to the LED illuminants 130 in a suitable manner. For this purpose, it is provided that the central region 20 is connected to both sides via a channel-like recess 37 or a channel portion with the two lateral regions 25 on the side opposite the hole 26 for supplying the external power supply cable. These recesses 37 and channel portions, which run transversely to the sealing structures 35 and locally interrupt them, can then be used in order to guide the lines or cables needed in order to power the LEDs 130 into the adjacent region 25 proceeding from the operating device 120, wherein a particularly preferred embodiment will be explained in more detail below.

Before explaining in detail below the sealing of the receiving chambers on the basis of the cooperation of the lamp housing 10 with the retaining element 50 and the covers 70 and 80, respectively, the configuration of the circumferential housing wall 12 will be explained in the following.

As aforementioned, this wall consists of four side wall regions 13 extending from the housing bottom 11, which are configured in the context of a deep-drawing process such that they expand away from the housing bottom 11 and thus extend in a funnel-like manner in the direction of the light emission of the lamp 1. The deep-drawing process advantageously results in that the side wall regions 13 at the corners of the housing 10 intersect with one another in an integral manner and thus no further measures are required in order to join the wall regions 13. The housing 10 can be embossed on the side wall regions 13 with overall stabilizing structures 14 and 15, wherein the structures 15 also facilitate handling of the lamp housing 10. In order to better mask these structures 14, 15 and to be able to additionally increase the stability of the housing 10, it is further provided that the circumferential housing wall 12 has a circumferential edge 16 projecting horizontally outward at its edge region. This edge 16 runs in a plane that is aligned parallel to the plane of the housing bottom 11 and additionally gives the lamp 1 a more harmonious overall appearance. Ultimately, the lamp housing 10 thus fulfills numerous important functions of the lamp 1 and can be produced in a simple and cost-effective manner in spite of everything.

In the following, the sealing of the three receiving regions 20, 25 for the operating device 120 about the LED illuminants 130 will now be explained in more detail. While the housing 10 provides the seals 40 surrounding these three regions 20 and 25, respectively, it is necessary that the regions 20, 25 are covered accordingly in order to protect the lamp components 120, 130 against external influences, in particular dust and/or moisture.

Figure 6:
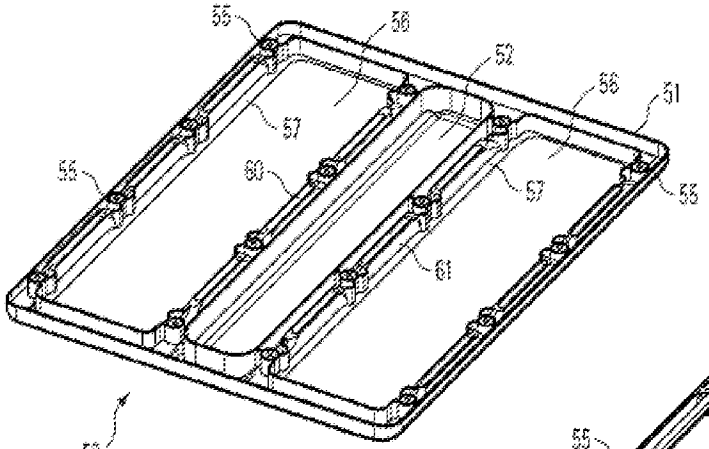
FIGS. 6 and 7 two views of a frame-like retaining element of the lamp.
Figure 7:
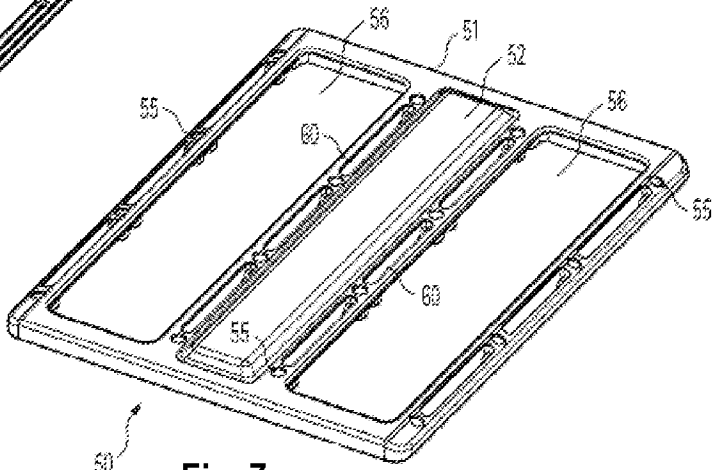
Figure 8:
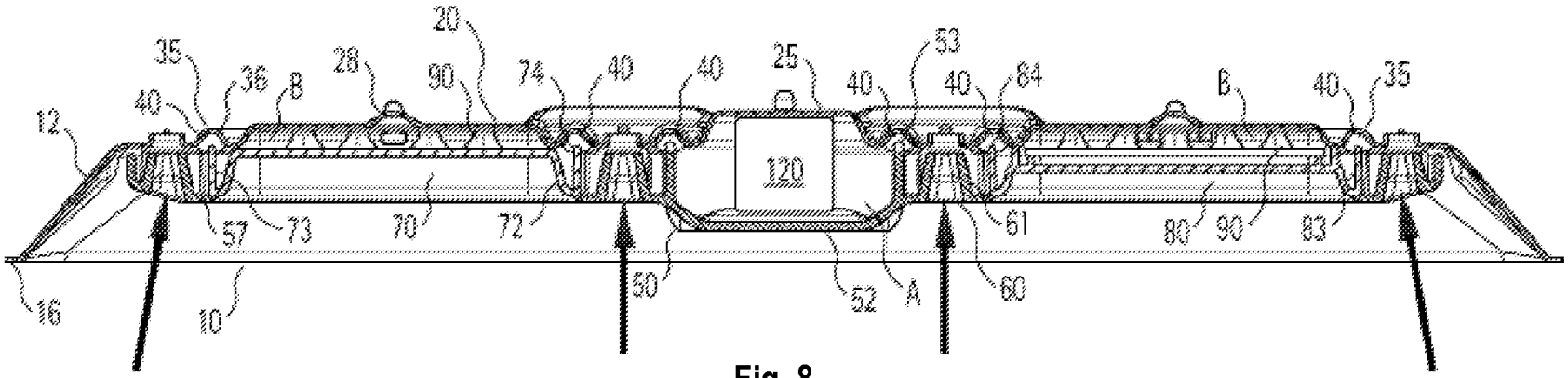
FIG. 8 a cross-sectional view of the lamp.

Responsible for this task is the aforementioned retaining element bearing the reference numeral 50, which is shown in isolation in FIGS. 6 and 7 and which cooperates with the lamp housing 10 in the assembled state corresponding to the sectional view of FIG. 8. In the illustrated exemplary embodiment, the retaining element 50 itself, however, only acts directly together with the seal 40 surrounding the central receiving region 20 for the lamp operating device 120, while the receiving regions 25 for the LED illuminants 130, on the other hand, are sealed by optics or translucent covers described in further detail below, which, however, are supported by the retaining element 50 in such a way that they sealingly cooperate with the corresponding circumferential seals 40.

Thus, as FIGS. 6 and 7 show, the retaining element 50 initially consists of a circumferential frame 51, approximately corresponding to the shape of the lamp housing 10 and thus square, which is bridged in the central region by an approximately hood-shaped cover 52. This domed or hood-shaped cover 52 easily hangs over the bottom (corresponding to the mounted orientation shown in FIG. 8) of the frame 51 in comparison to the plane such that it forms a somewhat recessed receiving chamber A or a chamber, as can be seen in the cross-sectional view of FIG. 8. Of course, the height and width of the cover 52 can be adjusted as needed to the dimensions of the operating device 120 as well as any other electrical or electronic operating components for operating the LED illuminants 130 to be positioned in the region of the operating device 120. It is also conceivable to use an additional carrier so that the components housed in this region can be mounted in multiple planes. Ideally, however, in the assembled state, the bottom of the cover 52 should not project beyond the plane of the circumferential rim 16 of the housing 10. In order to increase the height of the receiving chamber A for the operating device 120, it is additionally provided in the illustrated exemplary embodiment that the plane of the central receiving region 20 is at a slight backward offset compared to the two lateral receiving regions 25. This can also be taken into account as part of the deep-drawing during production of the housing 10.

The decisive factor is that the hood-shaped cover 52 has on its region facing the housing bottom 11 a circumferentially closed edge 53 or rim, which, in the assembled state of the retaining element 50 on the lamp housing 10, contacts the seal 40, in particular—as shown—dips into the flexible material of the seal 40. The central receiving chamber A is thereby jointly enclosed by the housing 10 and the retaining element 50 in a completely sealed manner, such that the operating device 130 is securely and reliably protected against external influences.

The fastening of the retaining element 50 to the housing 10 is carried out here via a plurality of screw connections, wherein the retaining element 50, which is preferably produced in the injection molding process, has corresponding openings 55 or cylindrical reinforcements with openings which correspond to openings 31 in the housing bottom 11 of the lamp housing 10. The bores 31 of the lamp housing 10 lie respectively outside the regions 20 or 25 to be sealed, for which reason simple bores or openings that completely penetrate the housing bottom 11 can actually be used here. However, alternatively, the bores 31 could have the aforementioned blind-hole structures on their rear side. Further, other through-openings or latching structures for preferably releasable fastening to the lamp housing 10 could also be optionally provided on the retaining element 50 by means of separate fasteners, such as screws.

A sealing corresponding to the previously described cooperation between the cover 52 and the seal 40 is also provided for the two receiving regions 25 for the LED illuminants 130, wherein, however, the retaining element 50 does not itself come directly into contact with the seals 40, but rather this function is fulfilled by a translucent cover 70 or 80. These covers 70, 80 are received in the region of openings 56 of the frame 51 formed on both sides of the hood-shaped cover 52, which ultimately form the light-emitting openings of the frame-like retaining element 50 and are held and positioned by the retaining element 50 such that they cooperate with the seals 40. FIG. 8 shows two different variants of the translucent covers 70, 80, which are shown individually in FIGS. 9 to 11 and 12 to 14, respectively. In both cases, the cover is also used in order to influence the light emitted by the LEDs or the bracket of a corresponding optics.

In principle, in both variants, the hood or dome-like cover 70 and 80 is provided in turn, such that a planar light output region 71, 81, which is circumferentially connected from a U-shaped edge 72, 82, having a leg 73, 83 that extends toward the seal 40, a transverse connecting leg, and an inner leg connecting the connecting leg to the remainder of the cover 70, 80, wherein the U-shape is on the one hand increases the stability of the cover 70, 80, and on the other hand the outer leg 73, 83, is oriented upwards and forms a sealing edge 74, 84 which is circumferential in a plane. The function of this sealing edge 74, 84 is comparable to the edge 53 of the cover 52. That is to say, in the assembled state, the edge 74 or 84 dips into the circumferential seal 40 at the housing bottom 11 of the lamp housing 10, thereby completely enclosing the corresponding receiving region 25 for the LED illuminants 130. In this case, too, a completely sealingly enclosed chamber is thus obtained, in which the LED illuminants 130 are now received.

The bracket or positioning of the cover 70 or 80 required for this purpose is realized by the retaining element 50, which comprises an inwardly projecting support edge 57 or a support web surrounding the two openings 56. As can be seen from the sectional view according to FIG. 8, the covers 70 or 80 are then floating with their lower edge of the U-shaped rim 72 on the support edge 57, wherein the dimensions of the retaining element 50 are selected such that it is ensured that the cover 70 or 80 actually sealingly cooperates with the respective seal 40. The support edge 57 extends in a plane transverse or orthogonal to a pressing direction for pushing the cover 70, 80 into abutment on the seal 40. Instead of the circumferential closed support edge 57 shown, support regions could also be provided which are then distributed, preferably evenly, around the circumference of the openings 56.

However, some play in the mounting of the cover 70 or 80 is desired to the extent that slight transverse displacements due to different coefficients of temperature expansion in the materials of the lamp 1 can thereby be absorbed. In the illustrated exemplary embodiment, the cover 70 or 80 is therefore not rigidly connected to the retaining element 50 or the lamp housing 10. Instead, when the lamp 1 is assembled, only the cover 70 or 80 is inserted into the retaining element 50 accordingly and then screwed to the lamp housing 10 in the manner previously described.

The two variants of the cover 70 and 80 shown in FIGS. 9 to 14 differ primarily in view of the mounting of further optical elements that are provided in order to influence the light emitted by the LED illuminants 130. In both cases, these are TIR lenses 90 positioned on the opposite rear side of the light-emitting surface of the respective cover 70, 80, which bundle and deliver the light emitted by an LED in a known manner towards the bottom in an oriented manner. It is ideally provided that a lens 90 is used for each LED or LED cluster of the illuminants 130, wherein the LED or the associated LED cluster then engages with the recess 91 formed on the top side of the lens 90. This arrangement of the lens 90 with respect to the associated LED, as well as the configuration of the lens 90, ensures that the light emitted by the LEDs in almost all directions is influenced in a desired manner and used for efficient light output.

Figure 9:
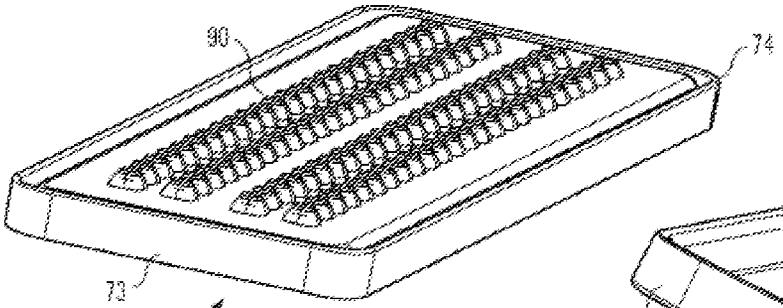
FIGS. 9 to 11 views of a first variant of a cover for the illuminants used in the lamp.
Figure 10:
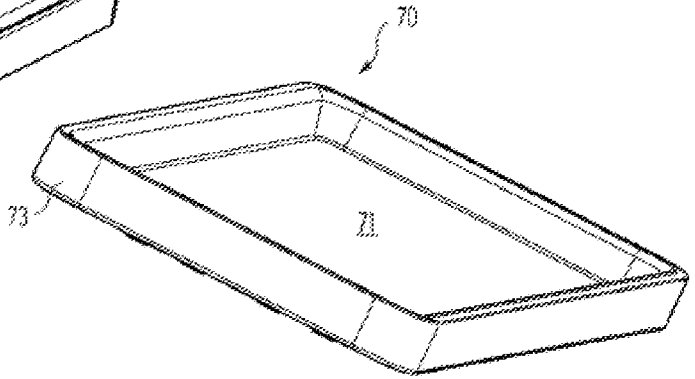
Figure 11:
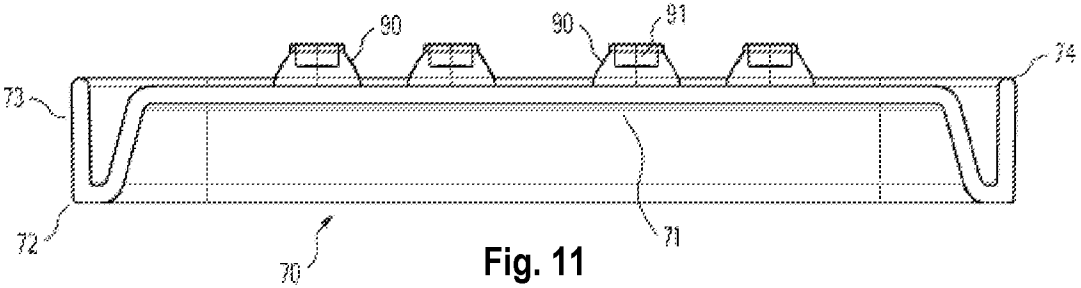

In the variant of the cover 70 shown in FIGS. 9 to 11, it is provided that the lenses 90 are an integral part of the cover 70 and are integrally formed at the rear side thereof in a corresponding manner. In this case, the cover 70 is then preferably made consistently of the same translucent material, wherein, in spite of everything, it would also be conceivable to form those constituents through which light passes or are intended to affect the light from a different material than the rest of the cover 70.

Figure 13:
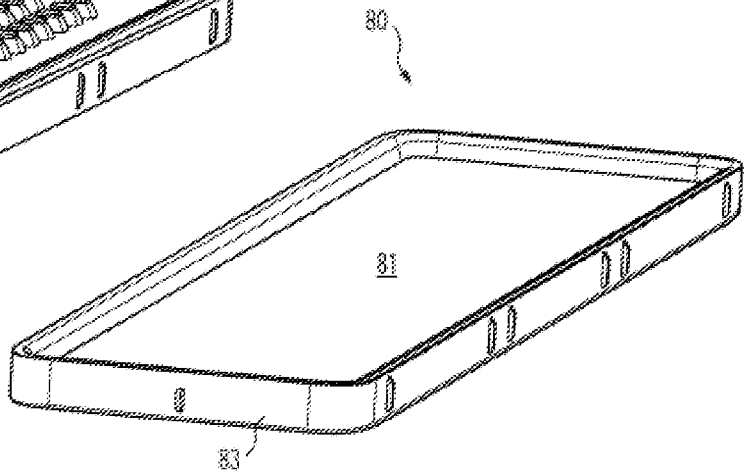
FIGS. 12 to 14 views of a second variant of a cover for the illuminants used in the lamp.
Figure 12:
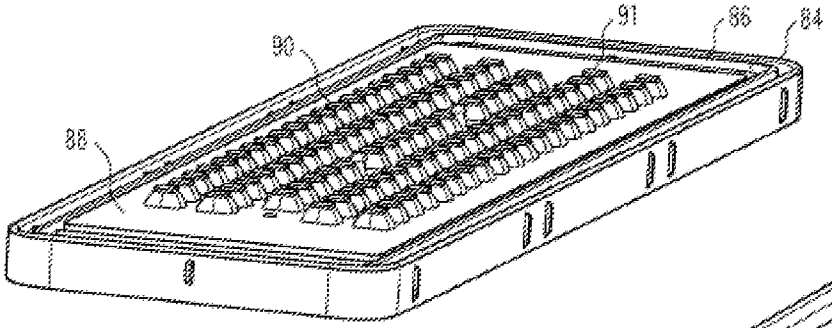
Figure 14:
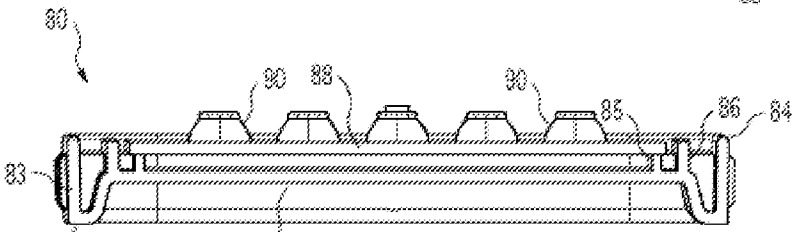

The variant shown in FIGS. 12 to 14, on the other hand, represents a particularly preferred embodiment for the cover 80, as the cover 80 now serves to additionally mount a separate component 88, which includes the lenses 90. For this purpose, the cover 80 on the rear side opposite the light output side has two circumferential webs 85 and 86, wherein the web 85 forms an annular support surface for the lens plate 88 with its upper edge, and the somewhat higher circumferential web 86 laterally encompasses the plate 88 with a small amount of play. The advantage of this solution is that the lens plate 88 can move slightly laterally compared to the cover 80, or slight displacements are possible. This opens up the possibility that the sealing edge 84 of the cover 80 is permanently in contact with the seal 40 and, in spite of everything, the lens plate 88 can possibly also migrate along with the LEDs. Temperature-related relative displacements can thereby be better captured, and a permanently correct positioning of the lenses 90 with respect to the LEDs is ensured. The correct alignment of the lenses 90 with respect to the LEDs can also be further supported in that cone-like positioning pins or centering pins, which are not shown in more detail, are formed on the lens plate 88 and engage with corresponding openings of the LED board 130. Corresponding protrusions 28 can be provided in the housing bottom 11 of the lamp housing 10, which allow the insertion of a corresponding centering pin but still do not impede the planar support of the LED board 130 on the receiving region 25. Of course, such positioning elements can also be utilized in the cover 70 according to the first variant.

As aforementioned, the variant shown in FIGS. 12 to 14 represents a particularly preferred embodiment for the design of the cover 80 as well as the associated optical system for influencing the light output. A further advantage of the mechanical decoupling between the cover 80 and the optics 88 is that the optics as well as the underlying LED boards 130 are less prone to impact, and damage due to vibrations, e.g. during transport of the lamp 1, can thus be avoided.

Of course, additional variations can also be carried out in the realization of the covers 70, 80. These relate, for example, to the design of the optical elements for influencing the light, wherein other light-refracting or light-scattering elements or structures could also be used as an alternative to the lenses 90 shown. In particular, suitable prism structures or otherwise configured lenses that could also be arranged on the bottom side, i.e. the light-emitting surface of the cover, could also be considered. Furthermore, additional films could be inserted in order to influence the light output in the desired manner. In principle, the optics can have optical materials such as scattering particles or conversion particles, optical structures such as a roughened surface, and/or optical elements such as lenses or a lens array.

The choice of the material can also be adjusted to the desired light output, in which case a choice of the material that influences the color tone or the color temperature of the emitted light would in particular also be conceivable. In the second variant, there is also the possibility of forming the cover 80 and the optics 88 from different materials. In this case, in particular for the cover 80, a chemically particularly resistant material can then be selected, whereas the optics 88 are formed from a material that can be used in a particularly suitable manner for influencing the light.

Finally, it would also be conceivable to design the cover 70, 80 such that it is an integral part of the retaining element 50. In particular, in the event that a separate lens plate 88 is again provided for influencing the light, as in the variant of FIGS. 12 to 14, the advantage can be achieved in spite of everything that, on the one hand, the receiving chamber B or the chamber for the LED illuminants 130 is permanently enclosed and, on the other hand, the lenses 90 are correctly positioned with respect to the LEDs.

In the cases described thus far, it has been assumed that the cooperation with the seal 40 is accomplished in that the corresponding rims or edges 53, 74 or 84 of the various covers 52, 70 or 80 penetrate into the seal 40, but are not connected thereto, so that removal of the retaining element 50 and the covers 70 and 80, respectively, is possible again at a later time. However, it could also be provided that the sealing material 40 is glued to the corresponding rims or edges 53, 74 or 84, whereby the sealing effect can additionally be increased. In this case, however, a later opening of the lamp 1, e.g. for maintenance purposes, is only possible by destroying the seal.

A further function of the retaining element is that it allows cool air to flow through the through-openings 30 of the lamp housing 10. For this purpose, the retaining element 50 has openings 60 corresponding to the through-openings 30 of the housing 10, which are each enclosed by circumferential webs 61. These webs 61 are oriented substantially transverse to the portion of the retaining element 50 comprising said webs, but in so doing are aligned at a slight incline and lie flush at their top side with the through-openings 30 of the lamp housing 10, so that cool air channels that extend slightly downward are formed which, as mentioned above, are formed on both sides of the receiving regions 20, 25 for the LED illuminants 130 as well as for the operating device 120.

The webs 61 can delimit the through-openings 30 of the lamp housing 10 laterally inward or outward and abut them in a preferred configuration. In this way, a corresponding splash protection can be provided so that no splash water enters into the chamber between the retaining element 50 and the cover 70 and 80, respectively, which would be particularly disadvantageous in the region of the seal 40. In order to still be able to discharge penetrating water, corresponding holes can be provided in the retaining element 50, for example, via which water can drain out of this delimited chamber.

The thermal through-openings 30 can be circumferentially curved inwardly or outwardly, as can be seen in FIG. 8. On the one hand, this in turn promotes the stability of the entire component, i.e. the housing 10. On the other hand, the edges of the thermal through-openings 30, which are particularly curved towards the retaining element 50, can form a preferably continuous and edge-side closed cool air channel with the aforementioned webs 61 of the retaining element 50.

The side walls 13 of the lamp housing 10, which extend downwardly in a funnel-like manner, form a respective air inflow surface laterally below the adjacent through-openings 30 and thus help to ensure that an air inflow region extending away from the illuminants 130 is formed overall, so that an efficient flow of cool air is enabled in spite of the surface that is large in relation to the construction height of the lamp 1. The heat occurring during operation of the lamp 1 can be efficiently dissipated by these air flows, which are indicated schematically with arrows in FIG. 8.

It is also advantageous in this respect that the receiving regions 25 for the LED illuminants—as well as the central receiving region 20—are designed to project from the rear side of the housing 10 in a trough-like manner. The cool air channels, which extend laterally to this recess, now ensure that the rearwardly projecting receiving region 25 for the illuminants 130 can be fed in with the resulting air flow in order to thus, for example, continuously avoid dust deposits on the rear side of the lamp 1.

The retaining element 50 is preferably designed as a single-piece plastic part and is produced in particular as part of an injection molding process. Depending on whether the covers 70 or 80 are intended to be an integral part of the retaining element 50, a two-component injection molding process can then also be used, if necessary. The use of a chemically resistant material is preferably provided at least for the cover 52 in order to be able to protect the lamp components arranged in chamber A to the greatest extent possible. Further, it would also be conceivable to design the retaining element 50 in multiple parts, but this leads to an increase in the number of components and is accordingly less preferable.

Finally, the aforementioned transverse connection between the two receiving regions 20, 25 for the operating device 120 and the LED illuminants 130 will be explained, which is responsible on the one hand for the respective receiving chambers A, B to be sealed accordingly and, on the other hand, for an electrical connection to be established between regions A and B that allows the LED illuminants 130 to also actually be able to be powered by the operating device 120.

It is initially provided that the shaft-like sealing structures 35 enclosing the receiving regions 20 or 25, which structures form the circumferential recesses 36 for receiving the seals 40, are interrupted at an end region of the receiving regions 20, 25 by a transverse channel portion 37 that opens towards the interior of the lamp, wherein the channel portion 37 connects the two receiving regions 20, 25 to one another, or two receiving regions 20, 25 to be connected to one another share a channel portion 37.

Figure 5:
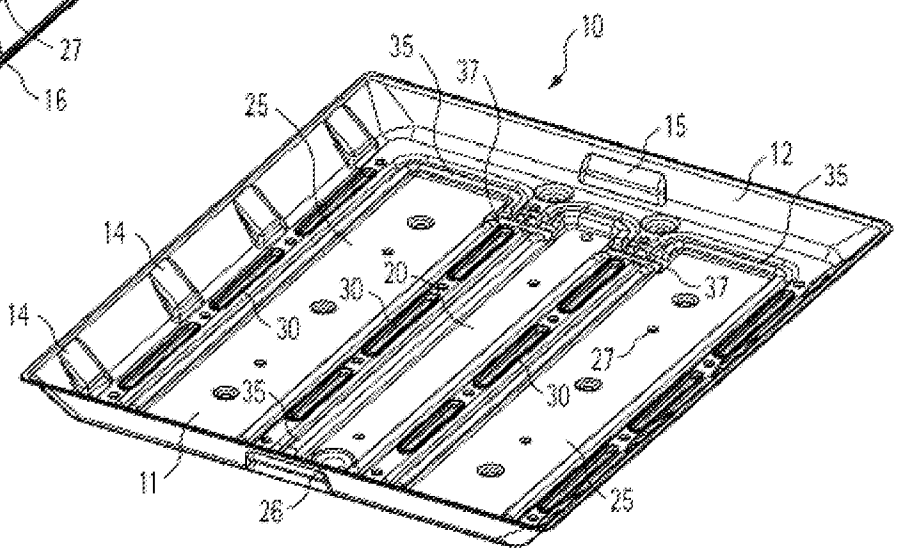

In FIG. 5, this transverse recess forming the channel portion bears the reference numeral 37, wherein, in a first variant, it would be conceivable that a supply cable is guided in this recess 37 from the one receiving region 20 to the adjacent receiving region 25 and is then covered by the seal 40. This measure requires that the supply cable be laid in a suitable manner even before the seal 40 is applied in the lamp housing 10, which would in principle be possible but is not necessarily desirable for production reasons.

Figure 15:
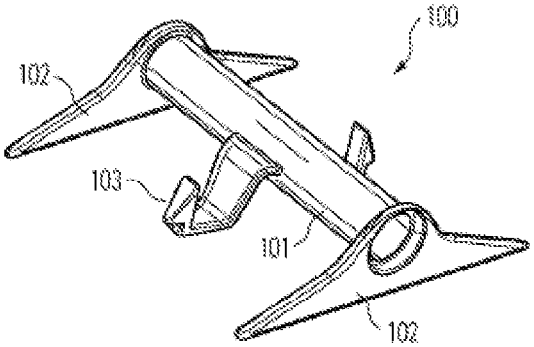
FIGS. 15 and 16 views of a component for bridging the sealing structures surrounding the receiving regions of the lamp housing.
Figure 16:
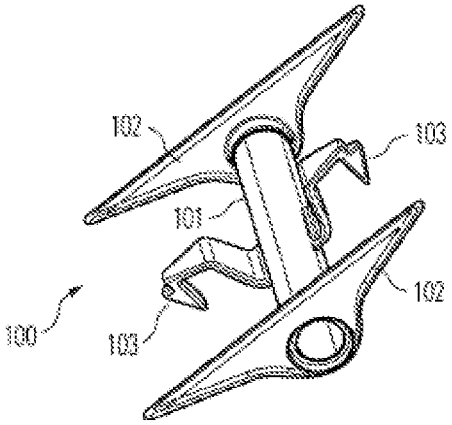

It would therefore be advantageous to create a sealed channel that allows the supply cables to be passed through even at a later time. In order to enable this, according to a particularly advantageous variant, it is provided that a channel-forming component 100 is used, which is shown in FIGS. 15 and 16. This component 100, which is preferably made of a plastic injection molded part, has in particular an elongated hollow cylinder 101, which has side walls 102 facing outwards at its two front ends. Furthermore, two opposing latch arms 103 are provided in the central region of the cylinder 101, which allow the component 100 to be fastened to the lamp housing 10. These structural portions 102, 103 thus cooperate with corresponding structural portions of the lamp housing 10 in order to mechanically connect the channel-forming component 100 to the lamp housing 10; they extend along the sealing structure 35 in order to be in planar abutment with the seal 40 and promote a distribution of the sealing material liquid-applied to the sealing structure 35 into the channel portion 37, as will be explained below.

Figure 17:
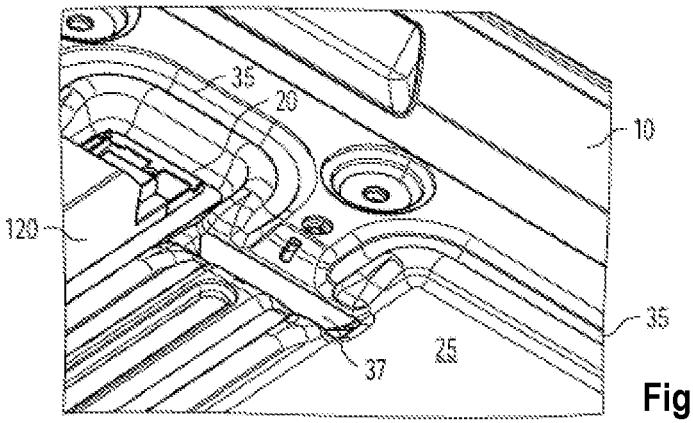
FIGS. 17 to 19 illustrations of the attachment of a seal surrounding the respective receiving regions in the lamp.
Figure 18:
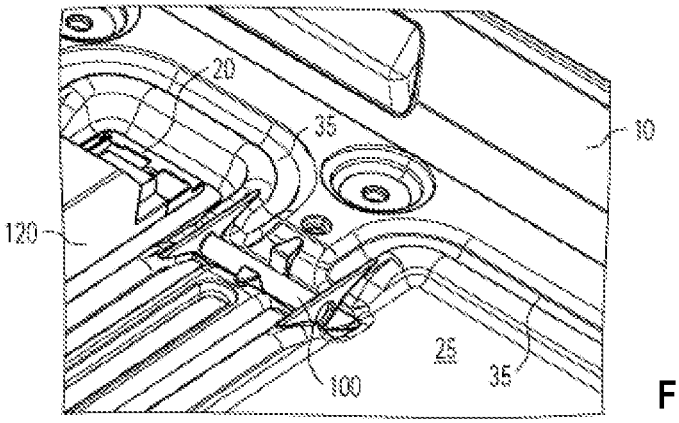
Figure 19:
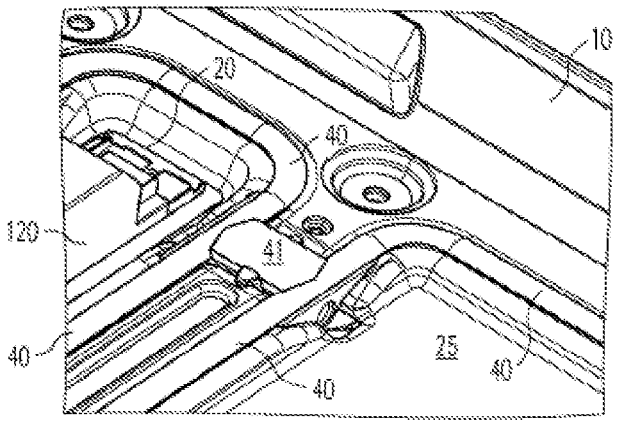

The function of the channel-forming component 100 can be seen in FIGS. 17 to 19, which show in individual steps how a sealing of two adjacent receiving regions 20, 25 takes place according to the preferred embodiment and, in spite of everything, it is ensured that they are connected to one another by a transverse channel such that the subsequent insertion of a supply cable is enabled.

FIG. 17 shows a home state in which neither the channel-forming component nor the seal have yet been introduced into the lamp housing 10. Only the two receiving regions 20 and 25 are discernible, which are enclosed annularly by the shaft-like sealing structures 35, wherein however the aforementioned transverse channel portion 37 interrupts both annular structures in order to connect the two receiving regions 20 and 25 to one another.

In a first step, shown in FIG. 18, the channel-forming component 100 is now inserted into the channel portion 37 such that the hollow cylinder 101 extends within the channel portion 37 and opens with its ends into the two receiving regions 20 and 25. A position-accurate locking of the channel-forming component 100 in this position is achieved with the aid of the two latch arms 103, which engage with corresponding latching structures of the lamp housing 10.

It can also be seen in this case that the side walls 102 of the channel-forming component 100 each continue the inner walls of the annular recess 36 for later receiving the seal. This allows the sealing material 40 to be inserted into the circumferential recess 36 in the final step shown in FIG. 19 and to be annularly and completely closed without the risk of the sealing material closing the end regions of the hollow cylinder 101 of the channel-forming component. The channel-forming component 100 is then at least partially sealingly surrounded by the seal 40 in the region of or along the sealing structure 35.

As shown in FIG. 19, the sealing material can be applied to the hollow cylinder 101 of the channel-forming component 100 in a completely covering manner, so that the mounting of the channel-forming component 100 on the housing 10 is thereby additionally improved. If necessary, the latch arms 103 could thus also be omitted, or another type of fastening for this component 100, e.g. adhesive, could be selected. In this case, all annular seals 40 are then integrally connected to one another via the channel-covering material 41, which in turn is facilitated in that all sealing structures 35 are in one plane, as discussed above.

The additional material 41 also completely fills the channel portion 37 and accordingly contributes additionally to the sealing. It is decisive that ultimately—as can be seen in FIG. 19—both receiving regions 20, 25 of the lamp housing 10 are completely annularly enclosed by a seal 40 and can accordingly cooperate with the retaining element 50 or the cover 70 or 80 in the manner described above in order to sealingly enclose the receiving chambers A and B, respectively. However, via the hollow cylinder 101 of the channel-forming component 100, both regions A and B are then connected to one another such that, even after the application of the sealing material 40, a supply cable is still allowed to be passed through. In turn, the assembly of the lamp 1 in its entirety is facilitated, wherein, in spite of everything, the lamp components 120, 130 are reliably and safely protected against external influences. A corresponding connection could also be created between the two receiving chambers B for the illuminants 130 with the aid of the component 100, to the extent that a corresponding channel is required due to the selected cable connections.

The described measures thus contribute overall to creating a lamp that is capable of producing and emitting high-intensity light as desired, however, the associated material and assembly costs are significantly reduced compared to previously known solutions.

A further advantage of the solution according to the invention, which is to be highlighted at this point, is that the assembly of all relevant components of the lamp takes place from one direction, namely from the bottom side or the light-emitting side of the housing. This applies to the arrangement of the seals as well as to the mounting of the illuminants, the operating components for operating the illuminants, as well as any connecting lines for the power supply of the illuminants. In principle, all of these components are introduced into the lamp housing from the same direction, and it is not necessary to perform any additional work from the rear. This is advantageous in that it does not require a turning of the housing during the assembly of the lamp, which opens up the possibility of automating the assembly process to a large extent or even completely. The lamp according to the present invention is thus not only characterized by its already described advantageous properties with regard to the light emission properties, the heat dissipation, and the resistance to external influences, but also by the advantage that the assembly of the lamp can be carried out relatively easily.

The concept according to the invention can also be easily implemented on other forms or sizes of the lamp. It is possible to expand the number of chambers or spaces for receiving operating devices or illuminants as desired, wherein, in particular, the option exists to realize a lamp housing, as shown in FIGS. 20 and 21, which has a total of four receiving regions for illuminants as well as two receiving regions for operating devices.

Figure 20:
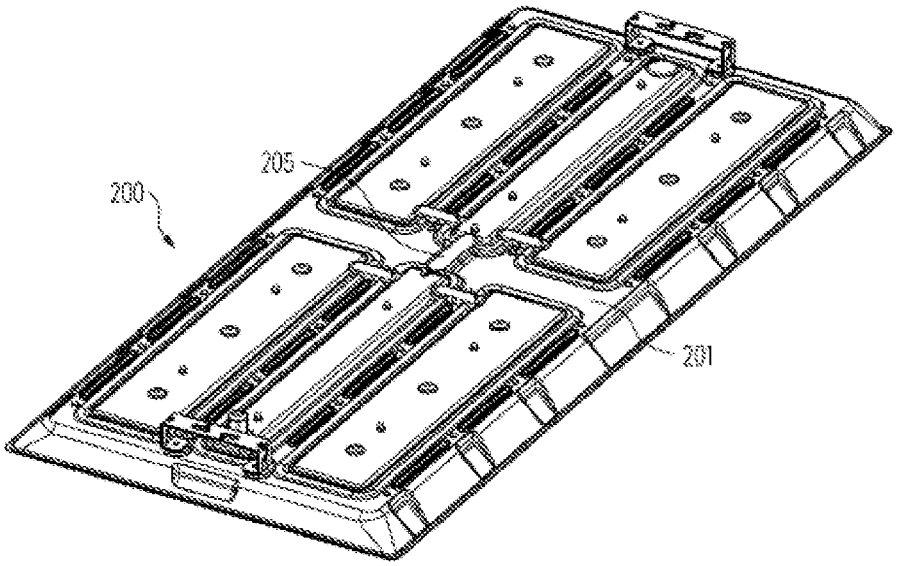
FIGS. 20 and 21 views of a further exemplary embodiment of a lamp having a lamp housing configured according to the present invention.
Figure 21:
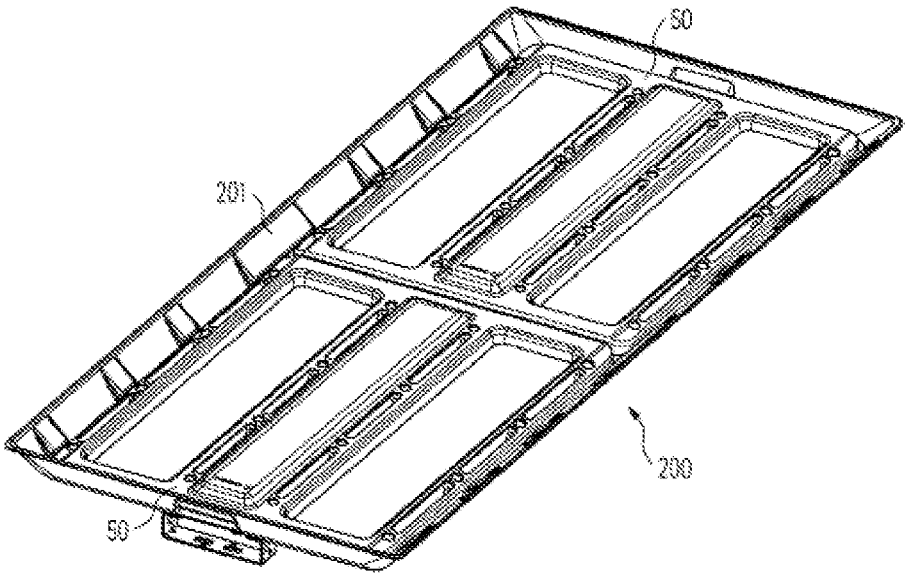

The lamp variant 200 shown in FIGS. 20 and 21 essentially represents a doubling of the concept described in the previous figures, wherein only the housing 201 must be provided in the elongated form, but identically configured retaining elements 50 can be used, wherein two retaining elements 50 are now used that are successively arranged in a longitudinal direction.

Also in this case, it is preferably provided—according to the illustration of FIG. 20—that the lamp 200 only comprises a single sealed connector for an external power supply cable. This requires that the two receiving regions for the operating devices must in turn be connected to one another in such a way that the laying of a connection cable is enabled. Accordingly, for connecting these two regions of the lamp 200, the use of a recess 205 in conjunction with the channel-forming component 100, which is explained in FIGS. 15 to 19, is preferably provided here, which connects the two regions which are successively arranged in a longitudinal direction.

The invention claimed is:

1. A trough-shaped lamp housing (10), which is integrally produced in a deep-drawing process, the lamp housing comprising:

a housing bottom (11) and a housing wall (12) which laterally surrounds the housing bottom (11) and which, together with the housing bottom (11), delimits a lamp chamber, wherein the housing bottom (11) has a planar region (20, 25) for receiving at least one lamp component (120, 130) in a planar manner, wherein the planar region (20, 25) is circumferentially surrounded by at least one of a raised or recessed plurality of annular structures (35) which are integrally formed in a deep-drawing process, the plurality of annular structures all extending in a same plane, and wherein the housing wall (12) discontinues at the circumferential edge thereof that faces away from the housing bottom (11) in a circumferentially closed edge portion (16), which lies in a plane, and wherein at least two adjacent annular structures (35) are connected to one another by a channel-like recess (37) in the housing bottom (11).

2. The lamp housing according to claim 1, wherein the plane of the edge portion (16) extends substantially parallel to the housing bottom (11).

3. The lamp housing according to claim 1, wherein the edge portion (16) is oriented laterally outward from the lamp chamber.

4. The lamp housing according to claim 1, wherein the annular structure (35) has a wave shape in cross-section, and/or wherein the annular structure (35) has a circumferentially substantially closed groove projecting toward the lamp chamber.

5. The lamp housing according to claim 1, wherein the housing wall (12) has structural elements (14, 15) which are integrally formed in a deep-drawing process.

6. The lamp housing according to claim 1, further comprising one or more through-holes (30) in the housing bottom (11).

7. The lamp housing according to claim 6, wherein a circumferentially closed edge that delimits the through hole (30) extends transversely to a portion or part of the lamp housing (10) comprising said edge.

8. The lamp housing according to claim 6, wherein the one or more through hole (30) extend adjacently to the planar regions (20, 25) for receiving lamp components (120, 130).

9. The lamp housing according to claim 8, wherein the housing bottom (11) has a plurality of planar regions (20, 25) for receiving lamp components (120, 130) in a planar manner, and two adjacent planar regions (20, 25) are separated from one another by a region having through-holes (30).

10. The lamp housing according to claim 9, wherein the regions (20, 25) for receiving lamp components (120, 130) in a planar manner are configured to be offset to a rear portion of the remaining housing bottom (11).

11. The lamp housing according to claim 10, wherein a first region (20) is provided for receiving an operating device and at least a second region (25) for receiving illuminants (130), and wherein the first region (20) is configured at a greater offset than the second region (25).

12. The lamp housing according to claim 1, further comprising one or more blind-hole structures (27) projecting outwardly with respect to the lamp chamber for receiving fasteners.

13. A lamp, comprising a lamp housing according to claim 1, as well as an illuminant, which is received in a planar manner on the planar region.

14. A trough-shaped lamp housing (10), which is integrally produced in a deep-drawing process, the lamp housing comprising:

a housing bottom (11) and a housing wall (12) which laterally surrounds the housing bottom (11) and which, together with the housing bottom (11), delimits a lamp chamber, and one or more blind-hole structures (27) projecting outwardly with respect to the lamp chamber for receiving fasteners, wherein the housing bottom (11) has a planar region (20, 25) for receiving at least one lamp component (120, 130) in a planar manner, wherein the planar region (20, 25) is circumferentially surrounded by at least one of a raised or recessed annular structure (35) which is integrally formed in a deep-drawing process, and wherein the housing wall (12) discontinues at the circumferential edge thereof that faces away from the housing bottom (11) in a circumferentially closed edge portion (16), which lies in a plane, and wherein the blind-hole structures (27) have structures which are formed integrally in a deep-drawing process or separate structures, wherein the separate structures are connected to at least one of: the housing bottom or the housing wall by means of at least one of: a force lock, material lock, or positive lock.

* * * * *